United States Patent [19]

Kuhfus

[11] 4,317,968

[45] Mar. 2, 1982

[54] MULTIPLE CANTILEVER SPRING CONTACT SWITCH

[75] Inventor: Gerd Kuhfus, London, Canada

[73] Assignee: Northern Telecom Limited, Montreal, Canada

[21] Appl. No.: 155,933

[22] Filed: Jun. 3, 1980

[51] Int. Cl.[3] ..... H01H 3/12

[52] U.S. Cl. ..... 200/5 R; 200/1 TK; 200/159 A; 200/153 LA; 200/314; 179/90 K

[58] Field of Search ..... 200/5 R, 340, 153 LA, 200/159 R, 159 A, 1 TK, 314; 179/158 R, 160, 90 K

[56] References Cited

U.S. PATENT DOCUMENTS 3,849,610 12/1974 Lockard et al. ..... 200/153 LA 4,096,368 6/1978 Grebner ..... 200/159 A

*Primary Examiner*—Gene Z. Rubinson

*Assistant Examiner*—Morris Ginsburg

*Attorney, Agent, or Firm*—Sidney T. Jelly

[57] ABSTRACT

A multiple cantilever spring contact switch has a base, a housing and a cap. A plurality of pairs of contacts are mounted in the base and the housing fits over the base and contacts. A cap is mounted for movement up and down on the housing and has a plurality of cam members which extend through slots in the housing aligned with the contacts. The cap is resiliently biased upward, and downward pressure on the cap moves the cap downwards and the cam members slide down the slots and actuate one contact of each pair. The contact pairs can be normally open or normally closed, or combinations thereof, and actuation of the one contact by a cam member changes the condition of the contact pair.

11 Claims, 21 Drawing Figures

MULTIPLE CANTILEVER SPRING CONTACT SWITCH

This invention relates to a multiple cantilever spring contact switch and is particularly, though not exclusively, concerned with line switches such as are used in telephone set and other telecommunications apparatus.

A large number of multiple contact switches are used in telephone sets, telecommunications apparatus and similar devices. The switches take different forms depending upon their function and are usually of relatively high labour content. Many of such switches are not enclosed, and are also fairly large. In such switches a variety of contact conditions can occur, such as normally made, normally open, and transfer, and one or more of each can occur in one switch. The present invention provides a switch which has a plurality of cantilever spring contacts, held in a base, within a housing, and a cap which fits over the housing has cam members which extend through slots in the housing. A spring between housing and cap biases the cap upward and pressure on the cap pushes it down, the cams sliding down the slots and actuating the contacts. The cap can be actuated directly or remotely.

The invention will be readily understood by the following description of some embodiments, by way of example, in conjunction with the accompanying drawings, in which.

Figure 9:
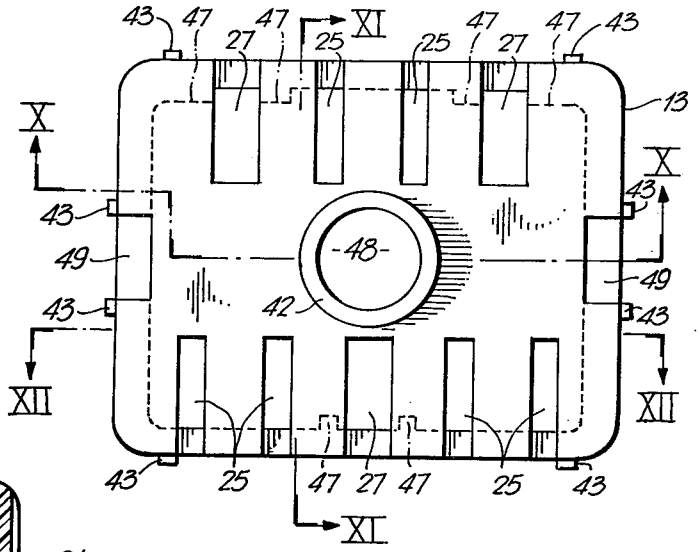
FIG. 9 is a plan view of a housing for use with the base of FIG. 6.
Figure 21:
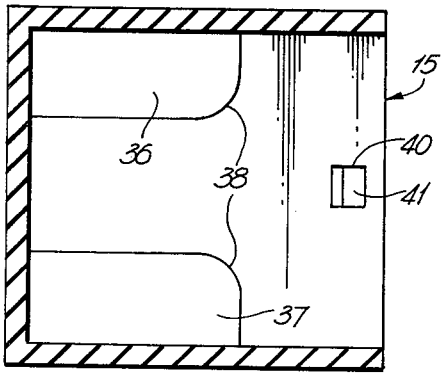
Figure 20:
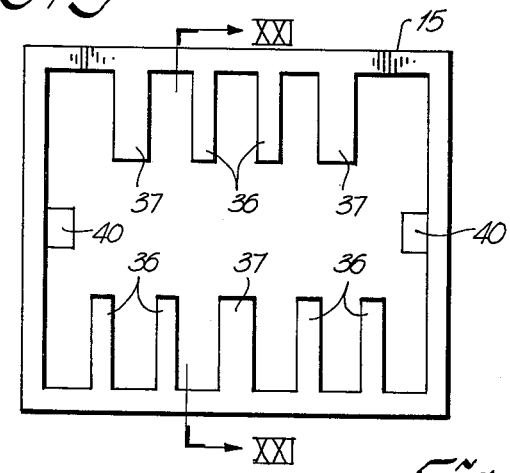

FIGS. 18*a*, 18*b*, 18*c* and 18*d* are end views of various contacts in FIGS. 14 to 17;

FIGS. 19*a*, and 19*b* are end views of two contact assemblies;

FIG. 20 is a bottom view of the cap for the housing of FIG. 9;

FIG. 21 is a cross-section on the line XXI—XXI of FIG. 20.

Figure 1:
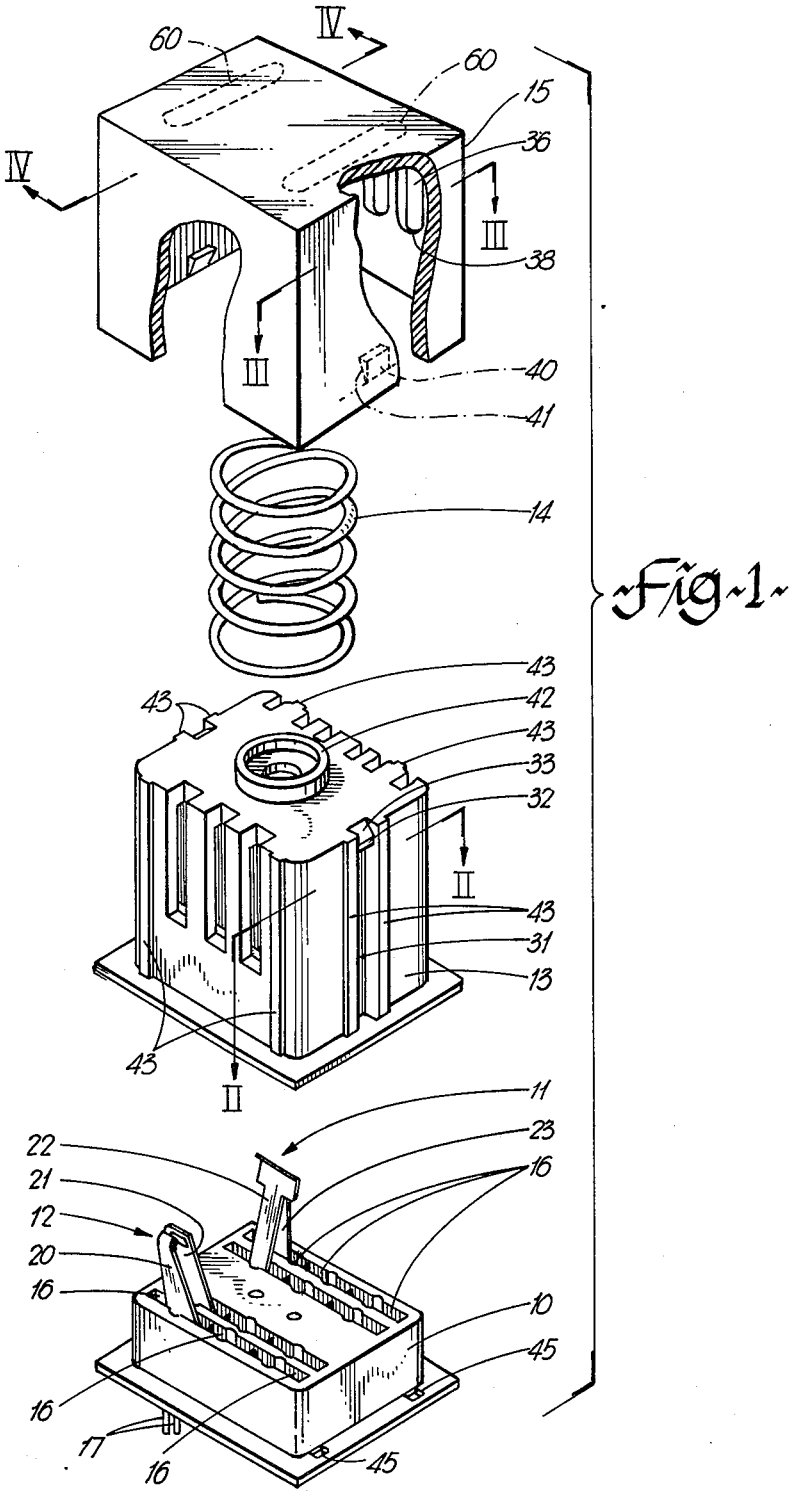
FIG. 1 is a perspective exploded view of one form of switch.

The switch illustrated in FIG. 1, comprises a base 10; a plurality of multiple contact assemblies 11 and 12 positioned in the base, only two forms being illustrated; a housing 13 which fits over the base 10 and contact assemblies 11 and 12; a compression spring 14 which rests on top of the housing 13; and a cap 15 which snaps over the housing 13.

Taking the various items singly, and in more detail, the base in the example illustrated, has two pairs of parallel rows of sockets for the receipt of contacts, the sockets indicated at 16. There are three sockets 16 in each row, two rows making a pair, providing three pairs of contacts. A pair of rows is provided at each side of the base, giving six pairs of contacts, or six contact assemblies 11 and 12. The contacts extend up from the base and also have tail portions 17 which extend below the base for attachment of conductors thereto or for insertion in a printed circuit board, or the like. While in FIG. 1 only two sets of contacts are shown, normally three sets of contacts 11 are provided along one side of the base 10 and three sets of contacts 12 along the other side. In the example, contact sets 11 are normally made, that is the contacts are so formed that normally they are in electrical contact with each other at their free ends, while the contacts 12 are normally open, that is the free ends spaced apart. To actuate, the outer contact 20 is pushed toward the inner contact 21 in contact set or assembly 12 and the inner contact 22 is pushed away from the outer contact 23 in contact set or assembly 11.

Figure 2:
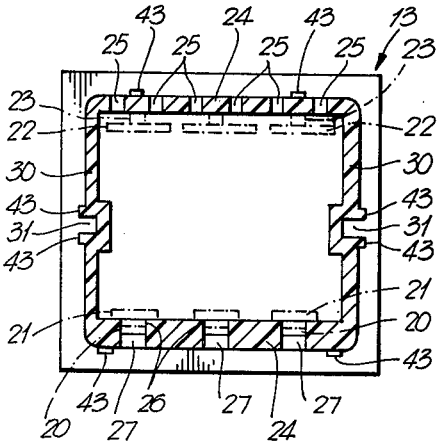
FIGS. 2 and 3 are cross-sections on the lines II—II and III—III respectively of FIG. 1.

The contacts are prepositioned by the housing 13. As seen in FIG. 2, the contacts, indicated in dotted outline, rest against the side walls 24 of the housing. The contacts 22 and 23 are in contact, the outer contact 23 against the wall 24 and the inner contact 22 being wider than contact 23, extending on either side. Slots 25 in the wall 24 of the housing permit cam members to act on the inner contacts as described later. There are two spaced apart cam members for each inner contacts, as is illustrated in FIG. 3.

The contacts 20 lie in grooves 26 in the wall 24. The grooves are deep enough that the contacts 20 lie below the inner surface of the wall. Contacts 21 are wider than contacts 20 and overlie the grooves, being thus spaced from the contacts 20. Slots 27 in the wall 24, aligned with grooves 26, permit cam members to act on the outer contacts, as will be described.

Formed in the outside of the end walls 30 of the housing 13 are two grooves 31. These grooves 31 extend from the bottom of the housing up to near the top, where a buttress 32 is formed. The buttresses 32 have downwardly and outwardly inclined top surfaces 33, the buttresses being seen in FIG. 1.

Figure 3:
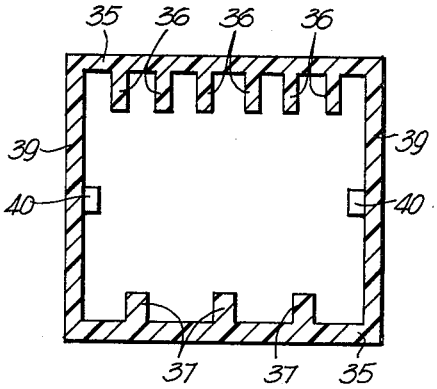

The cap 15 is seen in cross-section in FIG. 3. On the inside of the side walls 35 are formed cam members 36 and 37. The cam members 36 are in pairs and slide in the slots 25 of the housing, while the cams 37 are individual and slide in the slots 27 in the housing. The cams 36 and 37 extend down from the top of the cap part way towards the bottom, and have rounded bottom ends 38, seen in FIGS. 1 and 4. On the inside surface of each end wall 39 is a projection 40, positioned near the bottom. The projections have inwardly and upwardly inclined bottom surfaces 41 and the positioning of the projections is such that they will slide in the grooves 31 of the housing. The cap is assembled to the housing, after positioning of the spring 14 on the housing, by pushing down the cap. The projections deflect outwards over the buttresses 32, by distortion of the cap sides by the inclined surfaces 33 and 41, and then snap in under the buttresses. The cap is then retained on the housing but can slide up and down.

The housing is assembled to the base by snap in, sonic welding, adhesive bonding or other method. An annular rib 42 can be provided on the surface of the housing 13. By making the cap of transparent or translucent material, a light source, for example a light emitting diode (LED) can be provided in the top of the housing.

Figure 4:
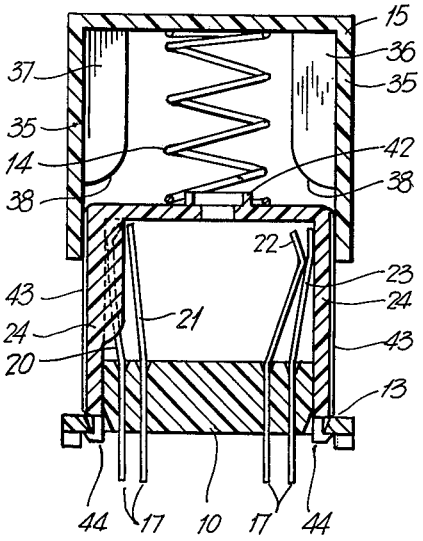
FIG. 4 is a cross-section on the line IV—IV of FIG. 1, of an assembled switch in the non-actuated condition.
Figure 5:
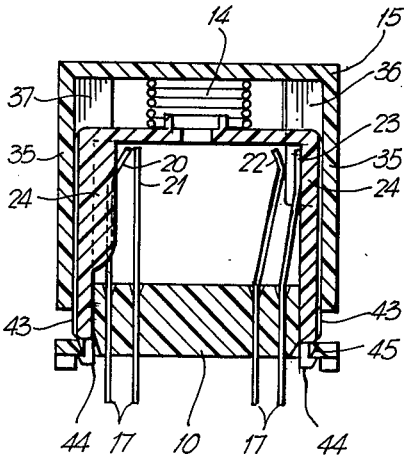
FIG. 5 is a similar cross-section to that of FIG. 4, with the switch in an actuated condition.

The operation or actuation of the switch can be appreciated from FIGS. 4 and 5. FIG. 4 shows the base 10 and housing 13 assembled and with the various contacts 20, 21, 22, 23 in position. The cap 15 is held or biased to the outermost position by the spring 14. As the cap 15 is pushed down, the cam members 36 and 37 slide in the slots 25 and 27 and move into contact with contacts 22 and 20 respectively. The spaced pairs of cam members 36 pass either side of a contact 23 and push against contact 22, opening or breaking electrical contact between the two contacts. Each single cam 37 pushes against the related contact 20 and moves it into electrical contact with a contact 21. By varying the length of the cam members 36 and 37, from the top of the cap 15, the actual timing or sequence of the making or breaking of contacts can be varied. Thus make before break, break before make and transfer operations can be provided.

To provide for easier accuracy in molding, and to reduce the friction during operation, ribs 43 are provided on the sides of the housing 13, the cap actually sliding on the outer surfaces of the ribs 43. In the example illustrated in FIGS. 1 to 5 the housing is assembled to the base by deflectable snap members 44 passing through apertures 45 in the base. These will be described in more detail with respect to FIGS. 6 to 13.

In the example illustrated in FIGS. 1 to 5, all the normally made sets of contacts 11 are on one side and all of the normally open sets are on the other side. This requires a fairly long switch because of there being three of the contacts 22 on one side, with the very wide form. Sufficient distance must be provided between contacts to avoid inadvertant touching. By altering the positions of contact sets, size can be reduced. Thus, two sets of contacts 11 can be positioned on one side, with one set of contacts 12 and one set of contacts 11 and two sets of contacts 12 on the other. Other arrangements of contacts can be provided, and the number of the different kind of contact sets can vary. Thus, in one extreme, all the contact sets can be as contact sets 11, that is all normally made, and in the other extreme the sets may be all normally open. Also the number of sets of contacts can vary, depending upon the particular requirements of the switch.

FIGS. 6 to 21 illustrate in more detail all of the various parts, that is base, housing, contacts and cap for a switch. Minor differences will be seen but these are only minor design features having no particular effect on the overall design and operation of the switch. The same references will be used, where applicable.

Figure 6:
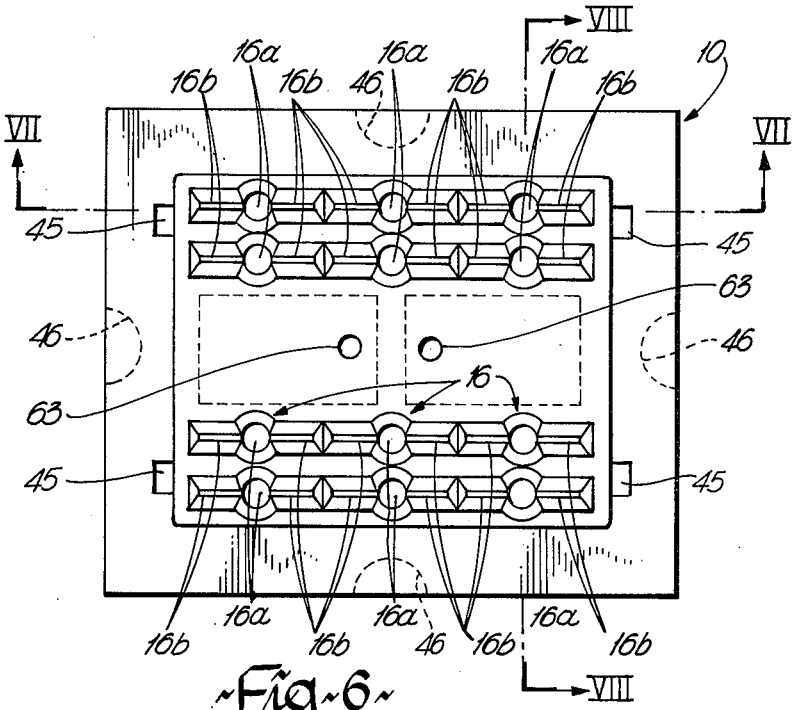
FIG. 6 is a plan view of a base for an alternative switch.
Figure 7:
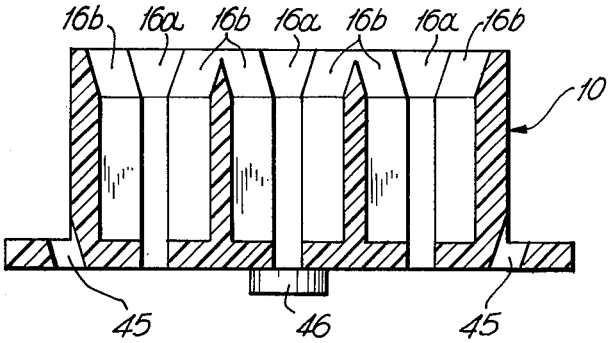
FIGS. 7 and 8 are cross-sections on the lines VII—VII and VIII—VIII respectively of FIG. 6.
Figure 8:
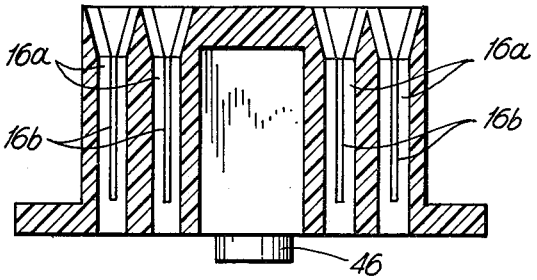

FIGS. 6, 7 and 8 illustrate the base 10. FIG. 6 shows the sockets, seen in vertical cross-sections in FIGS. 7 and 8. The sockets each have an enlarged circular section 16*a* which extends top to bottom and also through the bottom of the base, with thinner sections 16*b* on each side, the sections 16*b* extending to the bottom of the base. Four feet or spacers 46 on the bottom surface of the base can be used to locate the base relative to a support member. The sockets are chamfered at their top edges for ease in assembling the contacts to the base.

Figure 11:
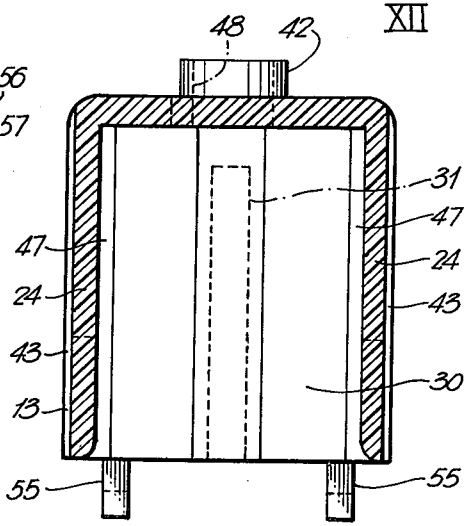
FIGS. 10, 11 and 12 are cross-sections on the lines X—X, XI—XI and XII—XII respectively of FIG. 9.
Figure 10:
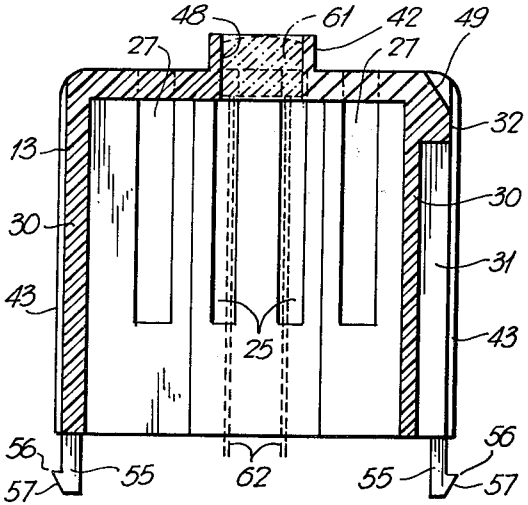
Figure 13:
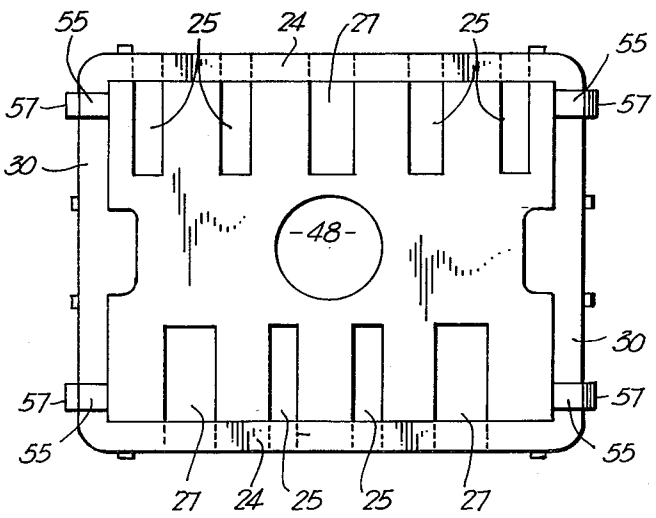
FIG. 13 is a bottom view of the housing of FIGS. 9 to 12.
Figure 12:
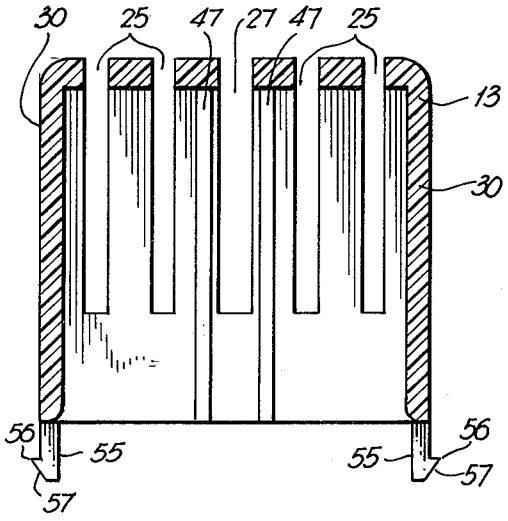

FIGS. 9 to 13 illustrate the housing 13. The housing in this example, in FIGS. 9 to 13, is for a switch having two sets of contacts 12 and one set of contacts 11 on one side, the top as seen in FIG. 9, and one set of contacts 12 and two sets of contacts 11 on the other side, the bottom in FIG. 9. Thus there are two individual slots 27 and one pair of slots 25 on the one side and one slot 27 and two pairs of slots 25 on the other side. These are also seen in FIGS. 10 and 12.

To provide for the normally open condition of contacts 20 and 21 forming a set of contacts 12, the wall of the housing is increased in thickness, at 47, on either side of each slot 27. This maintains contact 21 spaced from contact 20. Also seen in FIGS. 9, 10 and 11 is the annular rib 42. In this example an aperture 48 is provided in which an LED can be mounted.

In FIG. 10 is shown one of the grooves 31. To assist in initial assembly of the cap to the housing, a local chamfer 49 is formed on the top edge of each end wall 30, seen also in FIG. 9. Ribs 43, as in the example of FIGS. 1 to 5, are provided on the outer surface of the housing.

Figure 14:
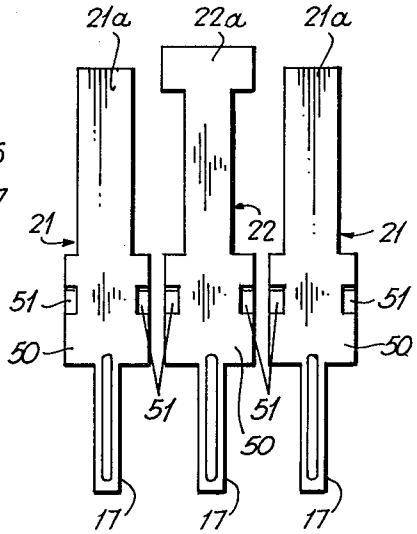
FIGS. 14 to 17 are side views of four sets of cantilever spring contacts for use with the base of FIG. 6.
Figure 15:
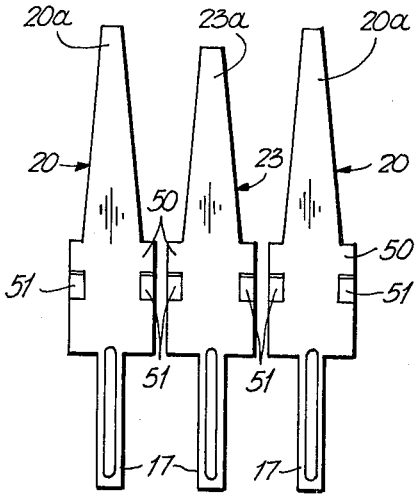
Figure 16:
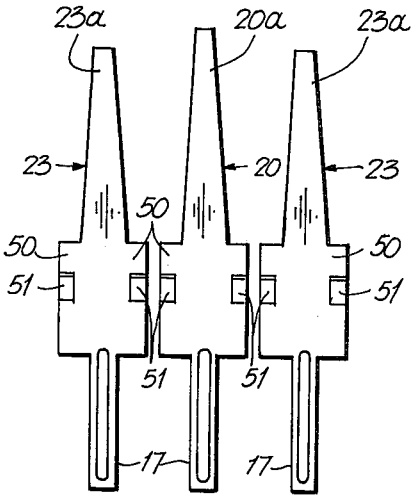
Figure 17:
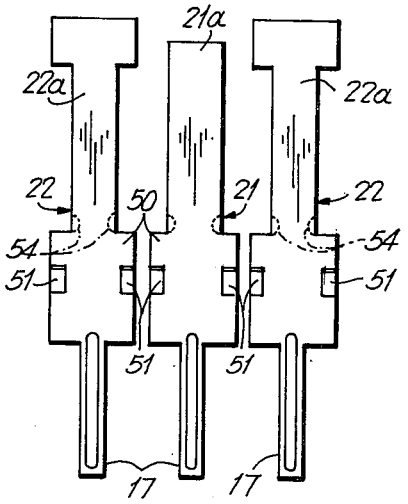
Figure 19:
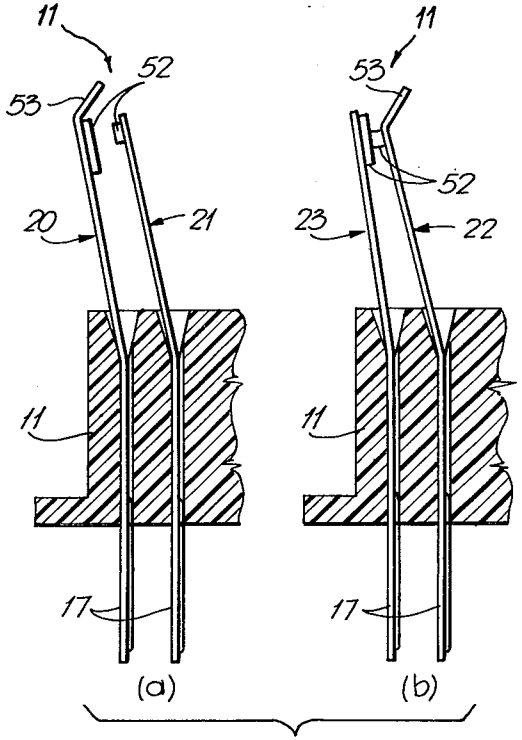
Figure 18:
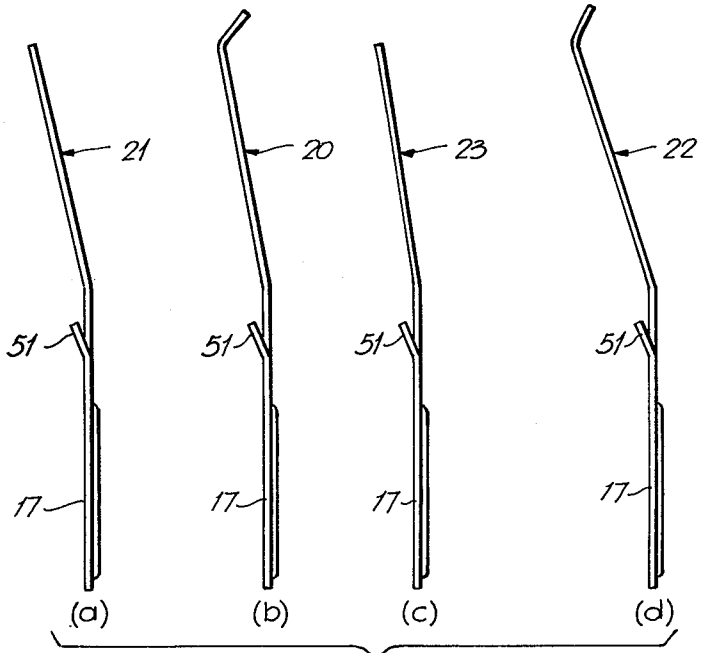

In the example so far described in relation to FIG. 6 to 13 there are six sets of contact pairs, three sets on each side and these sets are composed from four forms of contact, indicated at 20, 21, 22, and 23 in FIG. 1. Considering first the side having two sets of contacts 12 and one set of contacts 11, FIG. 14 illustrates the contacts 21 and 22 which are the "inside" contacts and FIG. 15 illustrates the contacts 20 and 23, which are the outside contacts. The other side, having two sets of contacts 12 and one set of contacts 11, comprises contacts as in FIGS. 16 and 17, FIG. 16 illustrating the "inside" contacts and FIG. 17 the "outside" contacts. FIG. 18 shows the form of the contacts in side elevation. It will be seen that each contact has a tail 17, a center portion 50 and the top portion 20*a*, 21*a*, 22*a*, and 23*a* respectively which is the contact portion and to which is attached a contact spot or member, as seen in FIG. 19. The center portions 50 are wider than the rest of the contacts and these portions fit in the thin socket sections 16*b* in the base 10. The tails 17 pass down the center parts 16*a* and through the bottom of the base, and are deformed, by a central groove, into an arcuate cross-section, for stiffness. Small sprags 51 on each edge of the centre portions 50 dig into the material of the base and hold the terminals securely in place once inserted. The positional relationship of the contacts is seen in FIG. 19, the contact spot or member on each contact indicated at 52. Contacts 20 and 22 are the ones acted upon by cam members and are therefore bent over at the top to give arcuate shapes 53 to provide smooth engagement with the cam members.

The various shapes of the top portions, 20*a*, 21*a*, 22*a* and 23*a*, as illustrated in FIGS. 14 to 17, can be varied to vary the spring rate (or contact pressure). Thus portions 20*a* and 23*a* can be narrower or wider where they join the center portions 50. Portions 21*a* and 22*a* can be wider or narrower. Also undercuts can be formed at the junctions between these portions, for example as indicated by dotted lines 54 in FIG. 17. Perforations can also be cut in these portions, to vary the characteristics.

FIGS. 20 and 21 illustrate the cap 15. As will be seen in FIG. 20, a bottom plan view, there is one pair of cam members 36 and two individual cam members 37 on one side cooperating with one pair of slots 25 and two individual slots 27 on the housing, with two pair of cam members 36 and one cam member 37 on the other side, to suit the two pairs of slots 25 and one slot 27, in the housing. The projections 40 are also shown.

The operation of the switch of FIGS. 6 to 21 is exactly the same as in FIGS. 4 and 5. Considering FIG. 4, on the left side there will be two sets of contacts 11, each composed of contacts 22 and 23, and one set of contacts 12, composed of contacts 20 and 21, the set of contacts 12 positioned between the two sets 11. On the right side there will be two sets of contacts 12 each composed of contacts 20 and 21 and one set of contacts 11 composed of contacts 22 and 23 positioned between the two sets 12. As the cap is pushed down, the cam members 36 and 37 act on the contacts 20 to push them towards contacts 21 and also on contacts 22 to push them away from contacts 23. As stated previously, the length of the cam members can be varied to give a desired sequence of operation.

In the particular example illustrated in FIGS. 6 to 13, and 19 and 20 as in the arrangement illustrated in FIGS. 1–5, the housing snaps into assembly with the base. Apertures 45 are formed in the bottom of the base, the apertures inclined downward and inward, as seen in FIG. 7. Extending downward from the base of the housing 13 are four legs or extensions 55 positioned to be aligned with the apertures 45. Towards the lower end of each leg or extension a projection 56 extends laterally outward and then the outer surface 57 extends downwardly and inwardly, to define an abutment or tooth-like projection. After positioning of the contacts in the base, the housing is assembled by pushing down over the base. The bottoms of the legs or extensions enter the apertures 45 and the inclined surfaces 57 cooperate with the apertures to deflect the legs inward until the projections 56 are below the bottom surface of the base, when they snap outward, holding housing and base together. Other ways of holding the base and housing together can be used, such as sonic welding, bonding, or screws.

As previously stated, an LED, or other light emitting device, can be positioned in the top of the housing. In FIG. 10, an encapsulated LED is indicated, in dotted outline and cross-section hatching, at 61. Leads, indicated at 62 are carried down and would pass through holes 63 in the top of the base, seen in FIGS. 6 and 8.

The switch is extremely simple, composed of three moldings, the contacts and a spring. The whole switch can be assembled by automatic assembly machinery with a considerable cost reduction. As stated, with a transparent or translucent cap, an LED can be mounted in the housing, either for illumination or as an indicator. Various indicia can be applied to the top of the cap. To reduce, or avoid any pumping action due to the motion of the cap, perforations can be provided in the top surface, as indicated at 60 in FIG. 1. A fine mesh or gauze would be positioned under the apertures.

The number of sockets 16 in a row can be varied. Thus only two pairs of sockets, and associated contacts, need be provided on either one side or both sides of the base, or more than three pairs of sockets, and associated contacts, can be provided. The particular arrangement of contact sets, normally open or normally closed, can also vary. It is even possible to provide a further row of sockets, and contacts, on at least one side, to provide a transfer function.

What is claimed is:

1. A multiple cantilever spring contact switch, comprising:

a base, a housing fitting on said base, and a captive cap fitting over said housing and including means for resiliently biasing said cap upwards on said housing away from said base;

said base including two pairs of rows of sockets, at least two sockets in a row, two rows making a pair, and a cantilever spring contact positioned in each socket to provide a plurality of pairs of contacts, the contacts of a pair having a predetermined biased relationship giving alternatively normally open and normally closed conditions as desired;

said housing being hollow and fitting over said base and said contacts and attached to said base, said housing including slots in side walls thereof, aligned with said contacts, said contacts being biased towards said side walls with at least the outer contact of each pair in contact with the inner surface of a side wall, said housing including means on the inner surfaces of the side walls for biasing an inner contact of a pair away from an outer contact where a normally open condition is required, and including two associated spaced apart slots at any position for a normally closed condition pair of contacts, the spacing of said two associated slots such that an outer contact rests against the side wall between the associated slots and an inner contact overlaps the associated slots;

said cap being hollow and having a top surface and sides, and including cam members on an inner surface of two opposed sides, said cam members extending through said slots in said housing;

said cams in an upward position of the cap, removed from said contacts and in a downward position each cam member engaging with and biasing one of a pair of contacts to change the condition of the pair;

means retaining said cap on said housing; and means for connecting electrical conductors to said contacts.

2. A switch as claimed in claim 1, said contacts comprising at least one pair of normally open contacts.

3. A switch as claimed in claim 2, said pair of normally open contacts having an inner contact and an outer contact, inward projections on said side wall, one on each side of said inner contact, said inner contact biased against said projections and spaced from said outer contact, and a slot in the housing aligned with the outer contact and between said projections whereby on depression of said cap, a cam member slides down in the slot and pushes said outer contact into contact with said inner contact.

4. A switch as claimed in claim 1, said contacts comprising at least one pair of normally closed contacts.

5. A switch as claimed in claim 4, said pair of normally closed contacts having an inner contact and an outer contact, a pair of said associated spaced apart slots positioned with a slot on each side of said outer contact, said inner contact biased against said outer contact and overlapping laterally said outer contact on each side thereof whereby on depression of said cap two cam members slide down the associated spaced apart slots and engage with and push said inner contact away from said outer contact.

6. A switch as claimed in claim 1, each of said contacts having a tail, a center portion and a top portion, said tail portions extending below a bottom surface of said base for connection of electrical conductors thereof, said center portions positioned in said sockets and said top portions extending upwardly from said base and including contact spots on an upper end of each contact.

7. A switch as claimed in claim 1, said means for resiliently biasing said cap upwards comprising a compression spring between said housing and said cap, and means on an upper surface of said housing for positioning said spring.

8. A switch as claimed in claim 1, including an aperture in a top surface of said housing and a light emitting device positioned in said aperture, said cap being of light transmitting material.

9. A switch as claimed in claim 6, including sprags extending from said center portion of each contact, said sprags extending from the plane of said center portion and digging into a side of a socket to retain the contact in the socket.

10. A switch as claimed in claim 1, including means retaining the housing on the base, comprising:

apertures through a bottom part of said base, and extensions extending down from a bottom surface of the housing, in alignment with said apertures, each of said extensions having an outwardly extending projection and an upwardly and outwardly inclined surface beneath the projection, whereby on pushing down the housing on the base, the extensions are pushed down through the apertures, being deflected inwardly by said inclined surfaces, the extension snapping outward when said projections are positioned below a bottom surface of the base, the projections locating below said bottom surface of said base.

11. A switch as claimed in claim 1, said housing including two grooves extending up opposite sides thereof and a buttress at the upper end of each groove;

said cap including a projection on an inner surface of each of two opposed sides adjacent to a bottom surface of the cap, the projections moved outwards over said buttresses and snapping back into said grooves beneath said buttresses when said cap is pushed on to said housing, said projections sliding up and down in said grooves on up and down movement of said cap.

* * * * *